US010249274B2

(12) United States Patent
Okuyama et al.

(10) Patent No.: US 10,249,274 B2
(45) Date of Patent: Apr. 2, 2019

(54) KEYBOARD MUSICAL INSTRUMENT, ADJUSTING METHOD THEREOF, AND COMPUTER-READABLE RECORDING MEDIUM THEREFOR

(71) Applicant: YAMAHA CORPORATION, Hamamatsu-shi (JP)

(72) Inventors: Fukutaro Okuyama, Hamamatsu (JP); Yasuhiko Oba, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 187 days.

(21) Appl. No.: 15/407,906

(22) Filed: Jan. 17, 2017

(65) Prior Publication Data

US 2017/0206869 A1 Jul. 20, 2017

(30) Foreign Application Priority Data

Jan. 18, 2016 (JP) ..... 2016-007375

(51) Int. Cl.

| | |
|---|---|
| ***G10F 1/00*** | (2006.01) |
| ***G10F 1/02*** | (2006.01) |
| ***G10H 1/00*** | (2006.01) |
| ***G10G 3/04*** | (2006.01) |
| ***G10H 3/24*** | (2006.01) |

(52) U.S. Cl.

CPC ..... *G10F 1/02* (2013.01); *G10G 3/04* (2013.01); *G10H 1/0008* (2013.01); *G10H 1/0066* (2013.01); *G10H 3/24* (2013.01); *G10H 2210/051* (2013.01); *G10H 2230/011* (2013.01)

(58) Field of Classification Search

CPC ..... G10F 1/02; G10G 3/04; G10H 1/0008; G10H 1/0066; G10H 3/24; G10H 2210/051; G10H 2230/011

USPC ..... 84/12

See application file for complete search history.

(56) References Cited

U.S. PATENT DOCUMENTS 7,435,895 B2 * 10/2008 Muramatsu ..... G10F 1/02 84/13

2014/0020543 A1 1/2014 Oba et al.

FOREIGN PATENT DOCUMENTS

JP 2014021233 A 2/2014

* cited by examiner

*Primary Examiner* — Jianchun Qin

(74) *Attorney, Agent, or Firm* — Rossi, Kimms & McDowell LLP

(57) ABSTRACT

A keyboard musical instrument includes a string-striking mechanism (hammer), driver, sound receiver, analyzer, and adjuster. The hammer strikes a string responsive to a change in position of an associated key of keyboard. The driver drives the hammer under a driving condition in accordance with control data. The sound receiver generates an audio signal corresponding to a sound occurring in the vicinity of the hammer. The analyzer detects the hammer striking a string by analyzing the audio signal generated when the hammer operates. The adjuster adjusts the control data in accordance with results of the analysis. The analyzer detects hammer striking a string in accordance with an intensity of the audio signal occurring within a search range, which has a predetermined relationship along a time axis with regard to a time at which the hammer commences operation.

6 Claims, 5 Drawing Sheets

FIG. 4
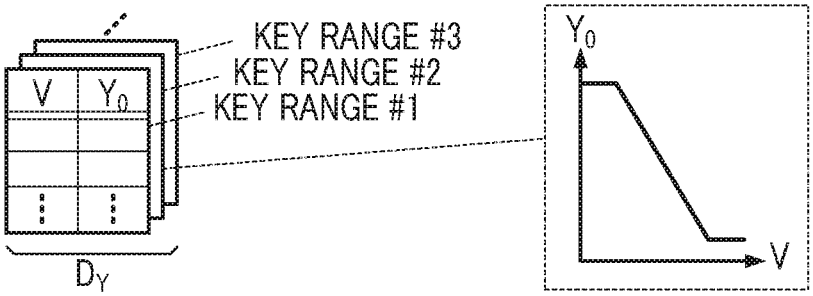
FIG. 5
| KEY | $C_X$ | $C_Y$ |
|---|---|---|
| #1 | | |
| #2 | | |
| ⋮ | ⋮ | ⋮ |
| #88 | | |
C
FIG. 6
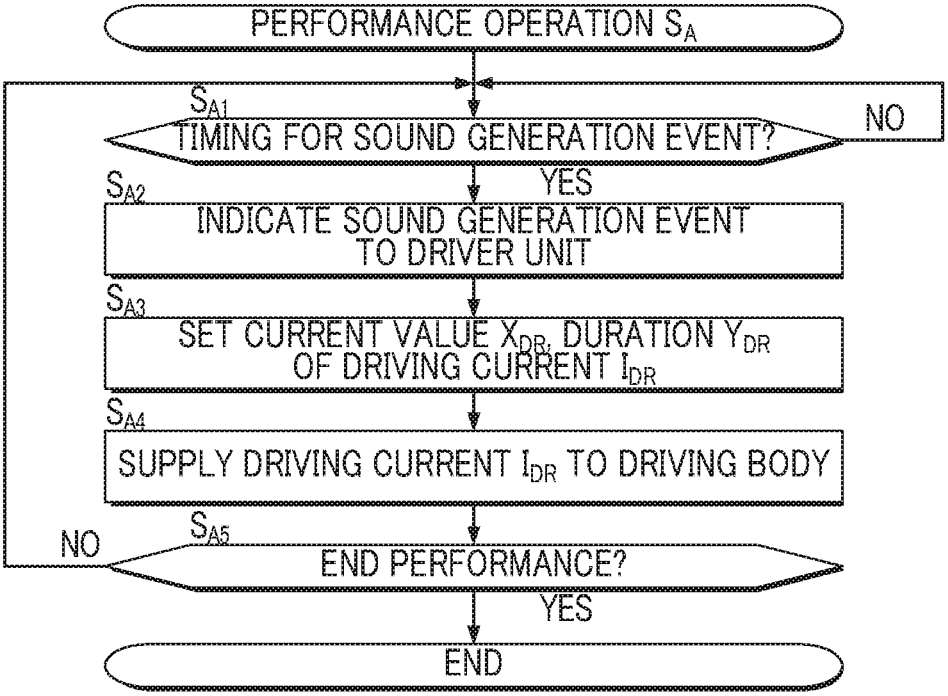

KEYBOARD MUSICAL INSTRUMENT, ADJUSTING METHOD THEREOF, AND COMPUTER-READABLE RECORDING MEDIUM THEREFOR

BACKGROUND

Field of the Invention

The present invention relates to a keyboard musical instrument that has auto-play capability.

Description of the Related Art

In keyboard musical instruments that have auto-play capability, it is necessary to minimize any error in a string-striking mechanism (action mechanism) that may occur as a result of manufacture or that develops over time due to aging, so as to maintain a desired operation of the string-striking mechanism. With a view to reducing any such error, Patent Document 1 (Japanese Patent Application Laid-Open Publication No. 2014-21233), for example, discloses a keyboard musical instrument in which key motion and string strike are detected by use of optical sensors that each include light emitting elements and light receiving elements for effecting servo control of key movement so that a trajectory of a hammer closely matches a target trajectory.

It is noted, however, that the invention set out in Patent Document 1 is subject to a drawback in that the configuration of the keyboard musical instrument is complex, since there is provided individually for each key of a keyboard, a(n optical) sensor that detects key motion and a(n optical) sensor that detects hammer motion. To overcome this drawback, an object of the present invention is to enable effective adjustment of movement of a string-striking mechanism by use of a simple configuration.

SUMMARY

In one aspect of the present invention there is provided a keyboard musical instrument in which the above-stated object is realized. In this aspect, the keyboard musical instrument of the present invention includes a string-striking mechanism configured to strike a string responsive to a change in position of an associated one of keys that constitute a keyboard; a driver configured to drive the string-striking mechanism under a driving condition in accordance with control data; a sound receiver configured to generate an audio signal that corresponds to a sound occurring in the vicinity of the string-striking mechanism; an analyzer configured to detect striking of a string by the string-striking mechanism through analysis of the audio signal generated when the string-striking mechanism operates; and an adjuster configured to adjust the control data in accordance with results of the analysis by the analyzer. The analyzer is configured to detect striking of a string by the string-striking mechanism in accordance with an intensity of an audio signal within a search range, the search range having a predetermined relationship along a time axis with regard to a time at which the string-striking mechanism commences operation.

In another aspect, there is provided an adjusting method of a keyboard musical instrument having a string-striking mechanism that strikes a string responsive to a change in position of an associated one of keys that constitute a keyboard, the method including: detecting striking of a string by the string-striking mechanism through analysis of an audio signal when the string-striking mechanism operates, the audio signal corresponding to a sound occurring in the vicinity of the string-striking mechanism and being generated by a sound receiver provided with the keyboard musical instrument, wherein the striking by the string-striking mechanism is detected in accordance with an intensity of the audio signal occurring within a search range, the search range having a predetermined relationship along a time axis with regard to a time at which the string-striking mechanism commences operation; and adjusting control data in accordance with results of the analysis, the control data designating a driving condition for driving the string-striking mechanism.

Further, in yet another aspect, there is provided a non-transitory computer-readable recording medium storing a program executable by a computer to execute the above method of adjusting the keyboard musical instrument.

BRIEF DESCRIPTION OF THE DRAWINGS

FIG. 4 is a schematic diagram indicative of duration data.

FIG. 5 is a schematic diagram indicative of correction data.

FIG. 6 is a flowchart showing a flow of a performance operation.

DETAILED DESCRIPTION

First Embodiment

Figure 1:
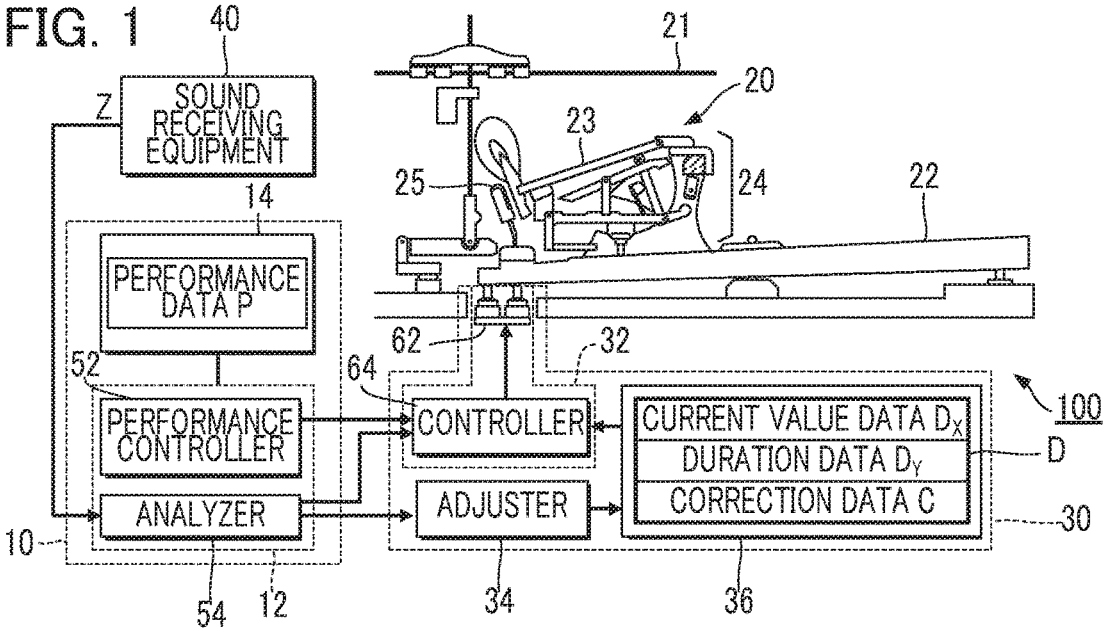
FIG. 1 is a diagram illustrative of a configuration of a keyboard musical instrument according to a first embodiment of the present invention.

FIG. 1 is a diagram illustrative of a configuration of a keyboard musical instrument 100 according to a first embodiment of the present invention. The keyboard musical instrument 100 of the first embodiment is an auto player piano that can be either freely played by a player or alternatively caused to automatically play a particular music track (hereinafter, a "target music track"). The keyboard musical instrument 100 includes a control unit 10, a string-striking mechanism 20, a driver unit 30, and sound receiving equipment (sound receiver) 40.

The control unit 10 includes a controller 12 and a storage device 14. The controller 12 is realized by processing circuitry such as a Central Processing Unit (CPU) or a Field-Programmable Gate Array (FPGA), and the controller 12 controls the different elements of the keyboard musical instrument 100 in an integrated manner. The controller 12 of the first embodiment functions as a performance controller 52 and an analyzer 54 by executing a program stored in the storage device 14. The storage device 14 stores programs to be executed by the controller 12, and various types of data for use by the controller 12. A publically known recording medium such as a semiconductor recording medium or a combination of multiple types of recording media may be freely selected for use as the storage device 14.

The storage device 14 of the first embodiment stores performance data P that designates a content of a performance for a target music track. The performance data P is time sequence data that designates pitches and intensities (hereinafter, "performance intensity") for the pertaining respective notes that constitute a melody of the target music track. More specifically, a Musical Instrument Digital Interface (MIDI) format file is preferably employed as the performance data P. The MIDI format data is formed from sound generating events each designating a pitch (a note number) and a performance intensity (velocity), and multiple pieces of time information each designating a processing timing of a corresponding sound generating event, the sound generating events and the time information being arranged in a time series corresponding to notes of the melody of the target music track.

The string-striking mechanism 20 is an action mechanism that strikes a string 21 according to a change in position of a pertaining key 22 of the keyboard, in substantially the same way as in an acoustic piano. The string-striking mechanism 20 of the first embodiment includes multiple sets consisting of a key 22, a hammer 23, a transmission member 24, and a back check 25, each set corresponding to an associated one of different pitches. A position of a key 22 is changed in accordance with an operation of a player; the hammer 23 strikes a string by pivoting; the transmission member 24 (e.g., a wippen, a jack, a repetition lever, etc.) causes the hammer 23 to pivot in conjunction with a change in position of the key 22; and the back check 25 halts the hammer 23 after the hammer has struck a string. It is of note that a specific structure of the string-striking mechanism 20 is not limited to the above example. Although FIG. 1 illustrates a string-striking mechanism 20 of a grand piano, a configuration can be employed in which there is employed, for example, a string-striking mechanism of an upright piano.

The driver unit 30 is an element that carries out a performance operation (automatic performance) of a target music track by driving the string-striking mechanism 20. The driver unit 30 includes a driver 32, an adjuster 34, and a storage circuit 36. The driver 32 and the adjuster 34 are realized by processing circuitry, such as a CPU or an FPGA, or an exclusive electronic circuitry.

The driver 32 drives the string-striking mechanism 20. The driver 32 of the first embodiment includes driving bodies 62, each arranged with respect to a corresponding one of the keys 22 of the keyboard, and a controller 64 that causes any one of the driving bodies 62 to operate. Each driving body 62 operates upon supply of a driving current $I_{DR}$, to drive the string-striking mechanism 20. More specifically, an actuator (typically, a solenoid) is preferably used as the driving body 62, wherein the actuator causes a change in position of the key 22 in substantially the same way as when the depression of a key is performed by a player. The controller 64 supplies each driving body 62 with a driving current $I_{DR}$, so as to drive the string-striking mechanism 20. A current value of the driving current $I_{DR}$ is set to be variable by pulse-width modulation that controls the pulse-width of a current signal that is supplied to each driving body 62.

The performance controller 52 of FIG. 1 controls the driver unit 30 in accordance with performance data P stored in the storage device 14, as the driver unit 30 operates in playing a target music track. The performance controller 52 of the first embodiment is a sequencer that notifies the driver unit 30 of each sound generating event sequentially designated by the performance data P. Such notifications are provided in order, at timings designated by time information. The controller 64 of the driver unit 30 supplies each driving body 62 with a driving current $I_{DR}$ according to the notification made by the performance controller 52. As a result, the keys 22 corresponding to pitches that are sequentially designated by the performance data P are driven in time order. In other words, automatic performance of the target music track is performed.

Figure 2:
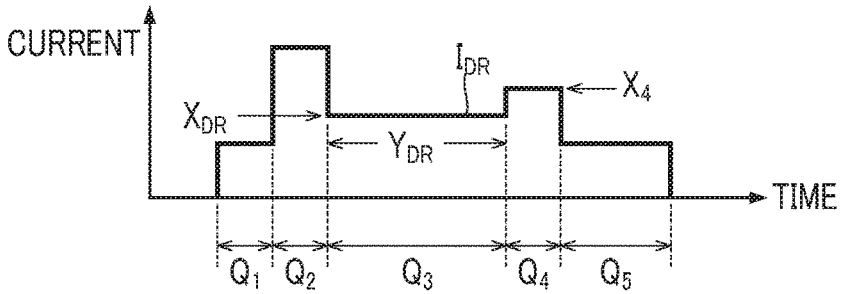
FIG. 2 is a waveform chart of a driving current supplied when a performance operation is being carried out.

FIG. 2 is a waveform chart of a driving current $I_{DR}$ that is supplied to one of the driving bodies 62 from the controller 64 when a performance operation is carried out. As shown in FIG. 2, the driving current $I_{DR}$ is segmented along the time axis into different sections (a preparation section $Q_1$, a start-up section $Q_2$, a driving section $Q_3$, a braking section $Q_4$, and a retaining section $Q_5$). It is of note that the waveform of the driving current $I_{DR}$ may be freely selected and is not limited to the example shown in FIG. 2.

The preparation section $Q_1$ is a section in which the subject driving body 62 that at an initial position exists separate from the associated key 22 is shifted to a position in contact with the key 22. The preparation section $Q_1$ is set to a predetermined current value and duration. The start-up section $Q_2$ is a section of a particular duration in which the string-striking mechanism 20 is started against static friction acting on the string-striking mechanism 20. A current value of the driving current $I_{DR}$ in the start-up section $Q_2$ exceeds that in the preparation section $Q_1$.

The driving section $Q_3$ is a section for controlling a speed of the hammer 23 in response to a change in position of a key 22. A current value $X_{DR}$ of the driving current $I_{DR}$ in the driving section $Q_3$ and a duration $Y_{DR}$ of the driving section $Q_3$ are set to be variable according to a performance intensity designated by the performance data P. An intensity of key depression and an intensity of string striking by the hammer 23 are changed in accordance with a performance intensity designated by the performance data P. As a result, a volume of a performance sound is controlled. Note that it is possible to control, in accordance with the performance intensity, a total duration of the start-up section $Q_2$ and the driving section $Q_3$ as the duration $Y_{DR}$.

The braking section $Q_4$ is a section for maintaining a state in which the hammer 23 is halted by the back check 25 after the hammer 23 has struck a string; in other words, the hammer 23 is prevented from rebounding. A current value $X_4$ of the driving current $I_{DR}$ in the braking section $Q_4$ is set to be a variable value that corresponds to a performance intensity designated by the performance data P, or alternatively, is set to a predetermined fixed value. More specifically, the current value $X_4$ of the driving current $I_{DR}$ in the braking section $Q_4$ is set to be within a range below the current value $X_{DR}$ of the driving section $Q_3$ when the performance intensity is at a maximum, and above the current value $X_{DR}$ of the driving section $Q_3$ when the performance intensity is at a minimum. The retaining section $Q_5$ is a section that is set to a prescribed current value and duration for the purpose of retaining the key 22 in a depressed state.

The storage circuit 36 of FIG. 1 is configured, for example, by use of a publically known recording medium such as a semiconductor recording medium and stores control data D. The control data D is data that designates a driving condition of the string-striking mechanism 20, and is used for the controller 64 that controls each driving body 62 by generation of the driving current $I_{DR}$. The control data D of the first embodiment determines the relationship between a performance intensity designated by the performance data P and respective ones of the current value $X_{DR}$ and the duration $Y_{DR}$ in the driving section $Q_3$ of the driving current $I_{DR}$. The control data D of the first embodiment includes, as exemplified in FIG. 1, current value data $D_X$, duration data $D_Y$, and correction data C.

Figure 3:
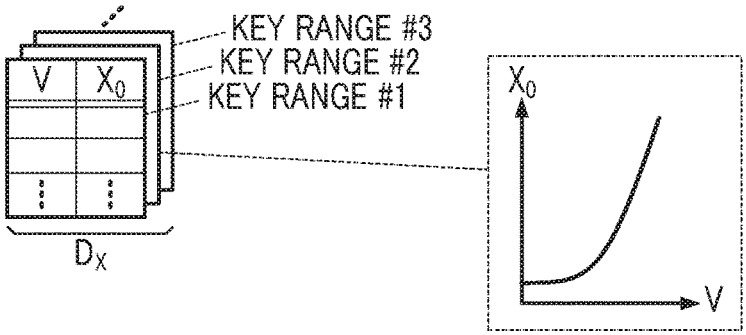
FIG. 3 is a schematic diagram indicative of current value data.

FIG. 3 is a schematic diagram explaining the current value data $D_X$. As shown in FIG. 3, the current value data $D_X$ prescribes, for each of ranges obtained by segmenting the keyboard by a predetermined number (singular or plural) of key(s) 22 (hereinafter, a "key range"), a relationship between a performance intensity V and a standard value of a current value $X_{DR}$ (hereinafter, a "standard current value $X_0$"). As also shown in FIG. 3, the current value data $D_X$ prescribes a relationship between the performance intensity V and the standard current value $X_0$, such that the standard current value $X_0$ increases as the performance intensity V increases. For ease of illustrative purposes, FIG. 3 shows a relationship between the performance intensity V and the standard current value $X_0$ for a single key range. The relationship between the performance intensity V and the standard current value $X_0$, however, may be set individually for each of the different key ranges of the keyboard, and may differ from one another. Since a current value of a driving current $I_{DR}$ is set in accordance with a duty ratio of a current signal generated by a pulse-width modulation that corresponds to the performance intensity V, the standard current value $X_0$ of the current value data $D_X$ is in actuality defined by the duty ratio of the current signal supplied to the driving body 62.

FIG. 4 is a schematic diagram explaining the duration data $D_Y$. As shown in FIG. 4, the duration data $D_Y$ prescribes, for each key range, the relationship between a performance intensity V and a standard value of a duration $Y_{DR}$ of a driving section $Q_3$ (hereinafter, a "standard duration" $Y_0$). As shown in FIG. 4, the duration data $D_Y$ prescribes the relationship between the performance intensity V and the standard duration $Y_0$ such that the duration $Y_{DR}$ generally decreases as the performance intensity V increases. The relationship between the performance intensity V and the standard duration $Y_0$ may be set individually for each of the different key ranges of the keyboard, and may differ from one another.

FIG. 5 is a schematic diagram explaining correction data C. As shown in FIG. 5, the correction data C designates, for every one of the keys 22, 88 keys in all, a correction value $C_X$ that corresponds to the standard current value $X_0$ and a correction value $C_Y$ that corresponds to the standard duration $Y_0$. The controller 64 decides a current value $X_{DR}$ of the driving current $I_{DR}$ in the driving section $Q_3$ by correcting the standard current value $X_0$ that is designated by the current value data $D_X$ for a key range that includes a key 22 (hereinafter, a "key to be played") that corresponds to a pitch designated in a sound generating event of the performance data P in accordance with the correction value $C_X$ that is designated by the correction data C for the key 22 to be played. For example, the controller 64 generates a driving current $I_{DR}$, with a total of the standard current value $X_0$ and the correction value $C_X$ being a current value $X_{DR}$ of a driving section $Q_3$. The controller 64 further decides a duration $Y_{DR}$ of the driving section $Q_3$ by correcting the standard duration $Y_0$ in accordance with the correction value $C_Y$, the standard duration $Y_0$ being designated by the duration data $D_Y$ with regard to a key range that includes the key 22 to be played and the correction value $C_Y$ being designated by the correction data C with regard to the key 22 to be played. For example, the controller 64 generates the driving current $I_{DR}$ such that the duration $Y_{DR}$ of the driving section $Q_3$ is equivalent to a total of the standard duration $Y_0$ and the correction value $C_Y$.

As will be understood from the above explanation, the driver 32 of the first embodiment drives the string-striking mechanism 20 under a driving condition (current value $X_{DR}$ and duration $Y_{DR}$) in accordance with the control data D. The driver 32 of the first embodiment includes driving bodies 62 that each drive the string-striking mechanism 20, and a controller 64 that drives the string-striking mechanism 20 by supplying the driving body 62 with a driving current $I_{DR}$ in accordance with the control data D. The control data D may be expressed as data that designates a driving condition (current value $X_{DR}$ and duration $Y_{DR}$) of the string-striking mechanism 20.

FIG. 6 is a flowchart illustrating a performance operation (automatic performance) $S_A$ in which driving bodies 62 are driven in accordance with performance data P of a target music track. For example, referring to FIG. 6, a start of performance operation $S_A$ is triggered, for example, by an instruction from a user of the keyboard musical instrument 100. When the performance operation $S_A$ starts, the performance controller 52 waits until a timing at which a sound generating event designated by performance data P is processed (a timing designated by time information) ($S_{A1}$: NO).

When the timing at which to process the sound generating event arrives ($S_{A1}$: YES), the performance controller 52 notifies the driver unit 30 of the sound generating event ($S_{A2}$). The controller 64 of the driver unit 30 sets a current value $X_{DR}$ and a duration $Y_{DR}$ that correspond to a performance intensity V designated by the sound generating event ($S_{A3}$). More specifically, as previously stated the controller 64 sets a current value $X_{DR}$ by correcting a standard current value $X_0$ of a key 22 to be played, and designated by the sound generating event in accordance with a correction value $C_X$ of the key 22 to be played. The controller 64 sets a duration $Y_{DR}$ by correcting a standard duration $Y_0$ of the key 22 to be played in accordance with a correction value $C_Y$ of the key 22 to be played. The controller 64 then supplies the driving current $I_{DR}$ of FIG. 2 to the associated driving body 62 of the key 22 to be played during the driving section $Q_3$ having the duration $Y_{DR}$, with the driving current $I_{DR}$ being set to the current value $X_{DR}$ ($S_{A4}$). The string-striking mechanism 20 strikes a string as a result of the driving current $I_{DR}$ being supplied, which in turn causes a striking sound having a pitch designated by the sound generating event to be generated at a volume corresponding to the performance intensity V. Automatic playing of the target music track is realized by the above processing being carried out for every sound generating event sequentially designated by the performance data P, until the end of the performance operation $S_A$ is instructed ($S_{A5}$: YES).

Characteristic errors (differences from a design value or differences between keys 22) due to manufacturing errors and/or aging may occur in the string-striking mechanism 20. If such a characteristic error occurs in the string-striking mechanism 20 relative to one or more of the keys 22, errors in a volume of a striking sound or a striking timing may result. The occurrence of such a characteristic error in the string-striking mechanism 20 tends to be audibly prominent upon generation of a soft sound generally within a range between a softest strike (pianissimo) to a soft strike (mezzo piano). Taking these factors into consideration, in the keyboard musical instrument 100 of the first embodiment an operation (hereinafter, an "adjusting operation") is carried out to compensate for either an error in the volume of the striking sound or an error in the striking timing. The adjusting operation can be carried out either prior to shipping of the keyboard musical instrument 100, or during a maintenance procedure, such as when the keyboard musical instrument 100 is tuned after a period of use. It is noted that a point in time or interval at which this adjusting operation is carried out can be freely selected.

The adjusting operation of the first embodiment is an operation that analyzes characteristics of the string-striking mechanism 20 relative to each of the keys 22, and adjusts a current value $X_{DR}$ and a duration $Y_{DR}$ in accordance with results of the analysis (calibration). More specifically, the adjuster 34 of FIG. 1 updates the control data D according to the characteristics of the string-striking mechanism 20 when it performs the adjusting operation. In the first embodiment, the correction data C (a correction value $C_X$ of the standard current value $X_0$ and a correction value $C_Y$ of the standard duration $Y_0$) of the control data D is updated by the adjusting operation such that an error in the striking sound volume or striking timing is compensated, with the error caused by a characteristic error of the string-striking mechanism 20.

The sound receiving equipment 40 (example of a sound receiver) shown in FIG. 1 generates an audio signal Z that corresponds to a sound occurring in the vicinity of the string-striking mechanism 20. The audio signal Z is a signal that represents the sound occurring in the vicinity of the string-striking mechanism 20. For example, an omnidirectional microphone may be preferably selected as the sound receiving equipment 40. An A/D convertor that converts the audio signal Z from analog to digital format is not shown for illustrative purposes.

Figure 7:
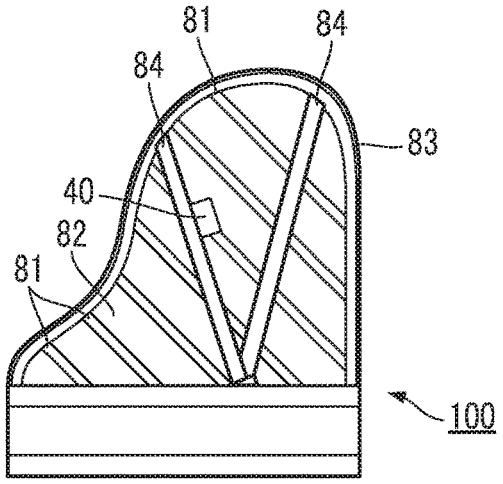
FIG. 7 is a bottom view illustrative of an undersurface of the keyboard instrument.

FIG. 7 is a plan view of the undersurface of the keyboard musical instrument 100, and an arrangement of the sound receiving equipment 40 is exemplified. As shown in FIG. 7, the keyboard musical instrument 100 includes a flat board shaped soundboard 82 with multiple soundboard ribs 81 attached to the undersurface, an outer rim 83 formed into a shape that surrounds the soundboard 82, and braces 84 that support the outer rim 83. The sound receiving equipment 40 of the first embodiment is fixed to one of the braces 84. The position of the sound receiving equipment 40 may be freely selected and is not limited to the example shown in FIG. 7. For example, the sound receiving equipment 40 may be mounted on the soundboard 82 or the outer rim 83. Alternatively, the sound receiving equipment 40 may be mounted on the upper surface of the keyboard musical instrument 100.

Figure 8:
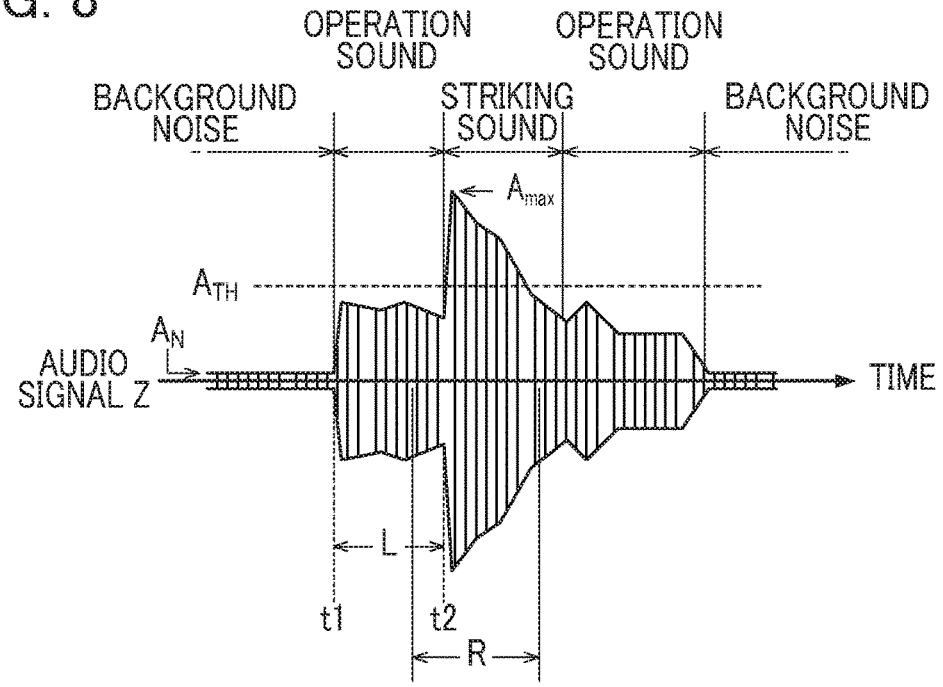
FIG. 8 is a waveform chart of an audio signal that is generated when a string has been struck.

FIG. 8 is a waveform chart indicating an audio signal Z generated when the string-striking mechanism 20 is operating after its activation. As shown in FIG. 8, when the string-striking mechanism 20 is activated by a supply of a driving current $I_{DR}$ to the driving body 62 having started at time point t1, an operation sound of the string-striking mechanism 20 (for example, a sound caused by the different parts of the string-striking mechanism 20 coining into contact with and sliding against each other) is received by the sound receiving equipment 40. The hammer 23 strikes a string at time point t2 that is delayed from time point t1, which is the time point at which driving of the string-striking mechanism 20 commences. The sound caused by this striking (hereinafter, a "striking sound") is received by the sound receiving equipment 40. Before the string-striking mechanism 20 operates (before time point t1), a background noise occurring in the vicinity of the sound receiving equipment 40 is received by the sound receiving equipment 40. A background noise is a noise component, examples of which include an operation sound of electric appliances, air conditioners, or the like in the vicinity to the keyboard musical instrument 100, or thermal noise of the sound receiving equipment 40. As shown in FIG. 8, an intensity of the striking sound (e.g., volume) tends to exceed the volume of an operation sound of the string-striking mechanism 20.

Figure 9:
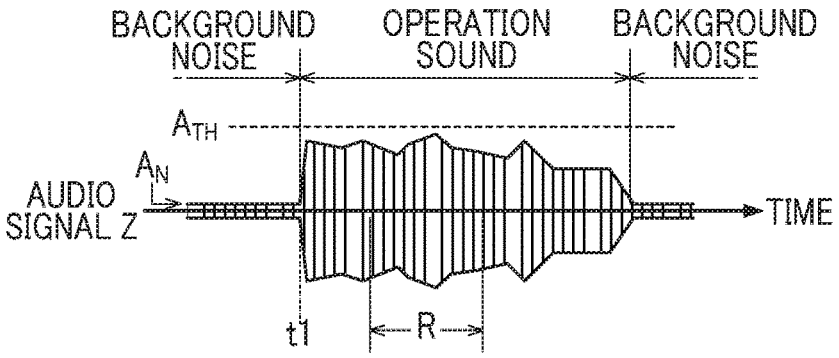
FIG. 9 is a waveform chart of an audio signal that is generated when no striking of a string has taken place.

When a current value $X_{DR}$ of the driving current $I_{DR}$ in the driving section $Q_3$ is small, however, although the string-striking mechanism 20 operates, the hammer 23 may not strike the string (hereinafter, a "non-striking instance"). FIG. 9 is a waveform chart of an audio signal Z generated in the non-striking instance. As will be understood from FIG. 9, in a non-striking instance, the sound receiving equipment 40 receives an operation sound of the string-striking mechanism 20 but not a striking sound. In other words, the waveform of an audio signal Z differs between a non-striking instance and a striking instance. As will be understood from the above explanation, by analyzing the waveform of an audio signal Z, it is possible to detect striking of a string that is created when the string-striking mechanism 20 is caused to operate (more specifically, to determine whether there was striking of a string or no striking).

The analyzer 54 of FIG. 1 analyzes an audio signal Z generated by the sound receiving equipment 40 when the string-striking mechanism 20 operates. More specifically, the analyzer 54 of the first embodiment detects striking of a string by the string-striking mechanism 20 through analysis of an audio signal Z that is generated when the string-striking mechanism 20 operates.

As stated previously, with respect to time point t2 that is delayed from time point t1, at which driving of the string-striking mechanism 20 commences, there is observed an increase in the intensity of an audio signal Z caused by a striking sound in the striking instance of the string-striking mechanism 20, but in the non-striking instance, such an increase in intensity as much as that observed in the striking instance tends not to be observed at time point t2. As is exemplified in FIG. 8, it is assumed that time point t2, at which a striking sound occurs, falls within a range (hereinafter, a "search range") R that has a predetermined relationship along the time axis with regard to time point t1, at which driving of the string-striking mechanism 20 commences. The search range R is a period that extends over a predetermined time, the starting point of which is a time point that is delayed by a predetermined time from time point t1, at which driving of the string-striking mechanism 20 commences.

As a consequence of the abovementioned tendencies, when the adjusting operation is carried out, the analyzer 54 of the first embodiment detects striking of a string effected by the string-striking mechanism 20 based on an intensity A of an audio signal Z within the search range R. More specifically, the analyzer 54 detects striking of a string by comparing the intensity A of the audio signal Z within the search range R with a threshold $A_{TH}$. For example, the analyzer 54 of the first embodiment determines that the string-striking mechanism 20 has struck a string when the intensity A of the audio signal Z within the search range R exceeds the threshold $A_{TH}$. The analyzer 54 determines that the string-striking mechanism 20 has not struck a string when the intensity A of the audio signal Z within the search range R is smaller than the threshold $A_{TH}$. Meanwhile, the analyzer 54 does not detect striking of a string outside the search range R. In this case, for example, the comparison between the intensity A and the threshold $A_{TH}$ may be omitted outside the search range R, or alternatively, it may be simply determined that there is no striking instance even when the intensity A exceeds the threshold $A_{TH}$ as long as it is outside the search range R.

The threshold $A_{TH}$ used in detecting striking of a string effected by the string-striking mechanism 20 is set to be variable according to an intensity (e.g., average volume) $A_N$ of a background noise that is observed before the string-striking mechanism 20 starts to operate. The greater the intensity $A_N$ of a background noise is, the greater the value to which the threshold $A_{TH}$ is set. More specifically, the analyzer 54 calculates the intensity $A_N$ of the background noise from the audio signal Z before driving of the string-striking mechanism 20 commences and detects striking of a string with the threshold $A_{TH}$ ($A_{TH}=\alpha*A_N$) being a value obtained by multiplying the intensity $A_N$ by a predetermined coefficient $\alpha$ ($\alpha>1$).

When the current value $X_{DR}$ of the driving current $I_{DR}$ in the driving section $Q_3$ is decreased stepwise, there occurs a shift from a state in which a striking sound is generated to a state in which a striking sound is not generated. Accordingly, detecting striking of a string for each of multiple cases in which the current value $X_{DR}$ of the driving current $I_{DR}$ is decreased stepwise, it is possible to identify, with regard to each of the keys 22, a minimum current value $X_{DR}$ (hereinafter, the "minimum current $X_{min}$") that enables the string-striking mechanism 20 to actually strike a string. The analyzer 54 of the first embodiment identifies, for each key 22, a minimum current $X_{min}$ from results of detecting striking of a string, the results indicating whether striking of a string occurred following commencement of operation of the string-striking mechanism 20 under supply of the driving current $I_{DR}$ of different current values $X_{DR}$. The minimum current $X_{min}$ is a current value $X_{DR}$ that causes the string-striking mechanism 20 to strike a string with the smallest intensity (softest striking).

The analyzer 54 identifies, for each key 22, a time (hereinafter, a "delay time") L that is from time point t1 to time point t2, wherein at time point t1 operation of the string-striking mechanism 20 commences under supply of the driving current $I_{DR}$, with the current value $X_{DR}$ in the driving section $Q_3$ being set to the minimum current $X_{min}$, and at time point t2 the hammer actually strikes the associated string.

The minimum current $X_{min}$ and the delay time L tend to change according to a characteristic error in the string-striking mechanism 20. Taking into account the abovementioned tendencies, the adjuster 34 of the first embodiment adjusts the control data D according to results of the analysis (minimum current $X_{min}$ and delay time L) by the analyzer 54. More specifically, for each key 22, the adjuster 34 updates the correction value $C_X$ according to the minimum current $X_{min}$ and updates the correction value $C_Y$ according to the delay time L. For example, a large minimum current $X_{min}$ means that the string-striking mechanism 20 operates with greater difficulty than that of its design, namely when no characteristic error is present, and the adjuster 34 accordingly sets the correction value $C_X$ to a large value so as to compensate for a lack of volume in the striking sound. Moreover, a long delay time L means that the string-striking mechanism 20 has more difficulty in moving as compared to that of its design, and the adjuster 34 accordingly sets the correction value $C_Y$ to a large value so as to compensate for a lack of duration of the driving section $Q_3$.

Figure 10:
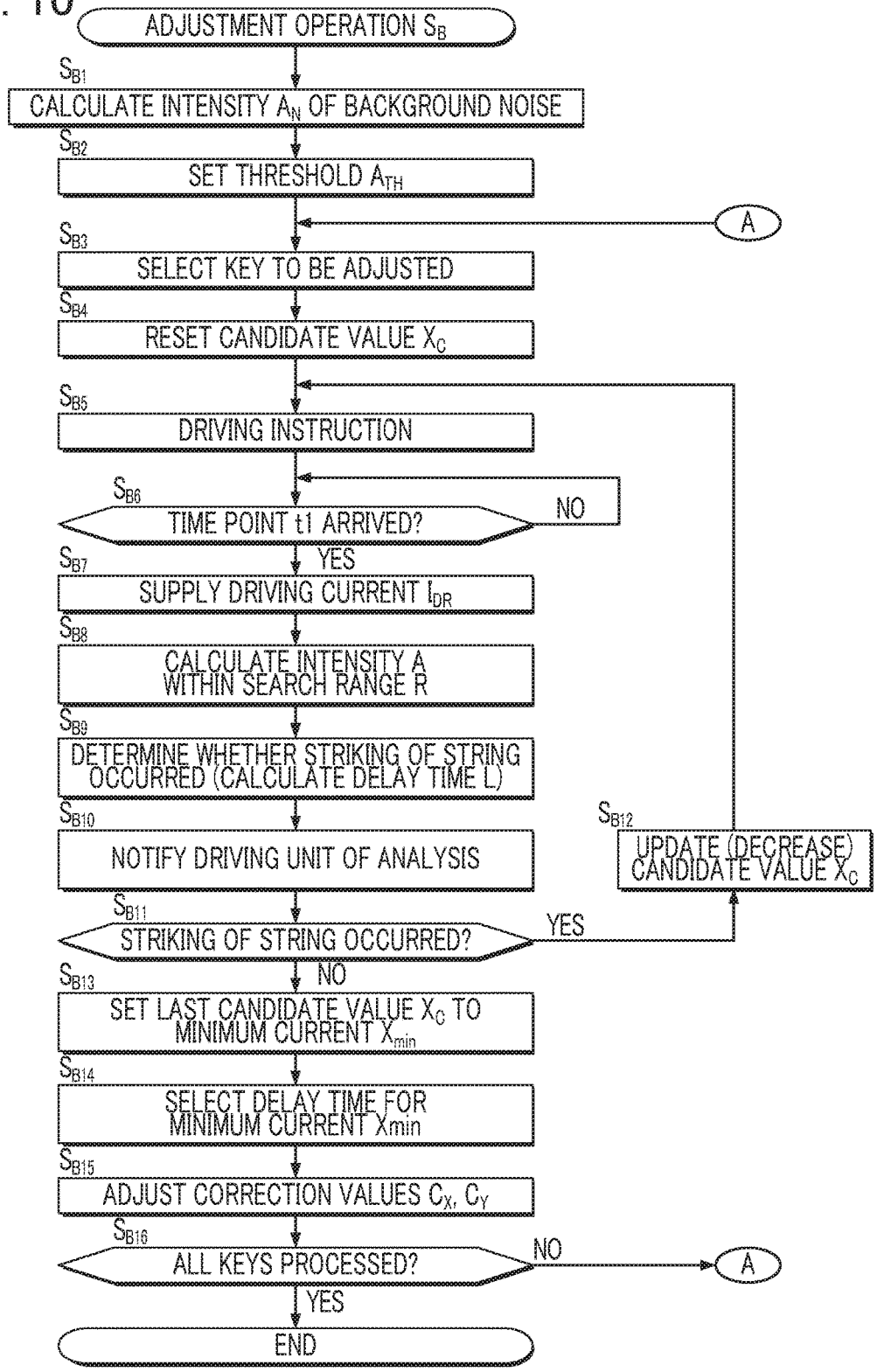
FIG. 10 is a flowchart showing a flow of an adjusting operation.

FIG. 10 is a flowchart showing a flow of an adjusting operation $S_B$ that adjusts the control data D according to results of the analysis of the audio signal Z. The adjusting operation $S_B$ of FIG. 10 is started, triggered by an instruction from a person adjusting the keyboard musical instrument 100, such as a person who manufactures or maintains the keyboard musical instrument 100.

When the adjusting operation $S_B$ starts, the analyzer 54 calculates an intensity $A_N$ of a background noise through analysis of an audio signal Z supplied from the sound receiving equipment 40 ($S_{B1}$). The analyzer 54 then sets a threshold $A_{TH}$ according to the intensity $A_N$ of the background noise ($S_{B2}$). The analyzer 54 selects one key 22 (hereinafter, a "key to be adjusted") that is to be adjusted out of the multiple keys 22 that constitute the keyboard ($S_{B3}$). Meanwhile, the controller 64 of the driver unit 30 resets a candidate value $X_C$ to a predetermined value, the candidate value $X_C$ being a candidate for the minimum current $X_{min}$ ($S_{B4}$). More specifically, the candidate value $X_C$ is reset to a relatively large value such that the string-striking mechanism 20 strikes the associated string without fail when the driving body 62 is supplied with the driving current $I_{DR}$ whose current value $X_{DR}$ in the driving section $Q_3$ has been set to the candidate value $X_C$.

The analyzer 54 transmits to the driver unit 30 an instruction (hereinafter, a "driving instruction") to drive a part of the string-striking mechanism 20 that corresponds to the key 22 to be adjusted ($S_{B5}$). The driving instruction includes a designation of time point t1 (e.g., a designation of a time of day of time point t1) at which the driving of the string-striking mechanism 20 should commence. The controller 64 of the driver unit 30, having received the driving instruction, waits until it reaches time point t1 designated by the driving instruction ($S_{B6}$: NO). When time point t1 arrives ($S_{B6}$: YES), the driver 32 supplies the driving body 62 with the driving current $I_{DR}$ and causes the string-striking mechanism 20 corresponding to the key 22 to be adjusted, to operate ($S_{B7}$).

Figure 11:
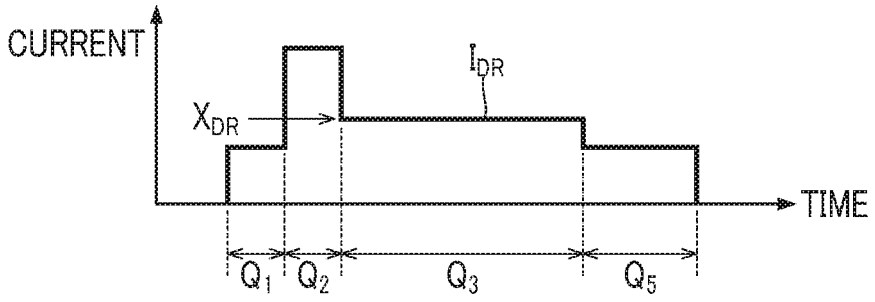
FIG. 11 is a waveform chart of a driving current supplied when an adjusting operation is being carried out.

FIG. 11 is a waveform chart of a driving current $I_{DR}$ supplied from the driver 32 to the driving body 62 for when the adjusting operation $S_B$ is carried out ($S_{B7}$). As shown in FIG. 11, the current value $X_{DR}$ in the driving section $Q_3$ of the driving current $I_{DR}$ is set to a candidate value $X_C$ as of the present stage. The duration $Y_{DR}$ of the driving section $Q_3$ is set to a predetermined value.

As it will be understood from FIG. 11, the waveform of the driving current $I_{DR}$ supplied to the driving body 62 when the adjusting operation $S_B$ is carried out is different from that shown in FIG. 2 when the performance operation $S_A$ is carried out. More specifically, as shown in FIG. 2, the driving current $I_{DR}$ supplied when the performance operation $S_A$ is carried out includes the braking section $Q_4$ for maintaining a state in which the back check 25 has halted the hammer 23, whereas the driving current $I_{DR}$ supplied when the adjusting operation $S_B$ is carried out does not include a braking section $Q_4$, as shown in FIG. 11. Even more specifically, the driving current $I_{DR}$ supplied when the adjusting operation $S_B$ is carried out maintains the candidate value $X_C$ in the driving section $Q_3$ and shifts to the retaining section $Q_5$ without increasing to the current value $X_4$ in the braking section $Q_4$ as exemplified in FIG. 2. As will be understood from the above explanation, as compared to when the performance operation $S_A$ is carried out, an external force to retain the back check 25 after striking of a string has occurred is reduced when the adjusting operation $S_B$ is carried out. Accordingly, in the adjusting operation $S_B$, there is reduced, as compared to when the performance operation $S_A$ is carried out, an operation sound that is generated from the string-striking mechanism 20 and the driver unit 30 as a result of an increase in the current value of the driving current $I_{DR}$ in the braking section $Q_4$. Such an operation sound is caused, for example, by the hammer 23 and the back check 25 of the string-striking mechanism 20 coining into contact with each other. In other words, the waveform of the driving current $I_{DR}$ supplied when the adjusting operation $S_B$ is carried out is a waveform that can reduce a volume of an operation sound of the string-striking mechanism 20, as compared to that of the driving current $I_{DR}$ supplied when a performance operation $S_A$ is carried out.

When a part of the string-striking mechanism 20 that corresponds to the key 22 to be adjusted operates under supply of the driving current $I_{DR}$, the analyzer 54 of the control unit 10 detects striking of a string by the string-striking mechanism 20 by analyzing an audio signal Z that is supplied from the sound receiving equipment 40 ($S_{B8}$ and $S_{B9}$). The analyzer 54 calculates the intensity A of the audio signal Z within the search range R that is later than time point t1 notified to the driver unit 30 by the driving instruction ($S_{B8}$). The analyzer 54 then determines whether striking of a string has taken place by comparing the intensity A and the threshold $A_{TH}$, which was set at step $S_{B2}$ ($S_{B9}$). More specifically, the analyzer 54 determines that a string striking has occurred when the intensity A exceeds the threshold $A_{TH}$ ($A>A_{TH}$), and determines that striking of a string has not occurred when the intensity A is smaller than the threshold ATH ($A<A_{TH}$). When a string has been struck, the analyzer 54 calculates a delay time L that is between time point t1 at which the string-striking mechanism 20 commenced operation under supply of the driving current $I_{DR}$ of the candidate value $X_C$ ($S_{B7}$) and time point t2 at which the hammer 23 actually struck a string. This process is carried out by the analyzer 54 by analyzing the audio signal Z. The analyzer 54 then notifies the driver unit 30 of the determination result as to whether striking of a string has occurred ($S_{B10}$). The controller 64 of the driver unit 30 recognizes whether striking of a string has occurred, through notification from the analyzer 54.

When striking of a string by the string-striking mechanism 20 has occurred ($S_{B11}$: YES), the controller 64 of the driver unit 30 decreases the candidate value $X_C$ by a predetermined value ($S_{B12}$) and repeats the process from the previous step $S_{B5}$ to step $S_{B11}$. Striking of a string by the string-striking mechanism 20 is determined for each of multiple cases corresponding to multiple values where the candidate value $X_C$ is decreased stepwise from an initial value.

When the candidate value $X_C$ falls below the minimum current $X_{min}$, the string-striking mechanism 20 enters a state in which it is incapable of striking a string even when supplied with the driving current $I_{DR}$ ($S_{B7}$). When striking of a string by the string-striking mechanism 20 has not occurred ($S_{B11}$: NO), the analyzer 54 sets as the minimum current $X_{min}$ a candidate value $X_C$ as of immediately before the current candidate value $X_C$ ($S_{B13}$). In other words, the smallest current that enables the string-striking mechanism 20 to actually strike a string is identified as the minimum current $X_{min}$. As an alternative, the analyzer 54 may calculate the minimum current $X_{min}$ by adding a predetermined value to the candidate value $X_C$ at a time point at which striking by the string-striking mechanism 20 has ceased to occur.

As the minimum current $X_{min}$ is determined, the analyzer 54 selects, as the determined value, a delay time L that corresponds to the candidate value $X_C$ set as the minimum current $X_{min}$ (i.e., the delay time L for when the minimum current $X_{min}$ is supplied), out of multiple delay times L calculated during striking instances for respective ones of the different candidate values $X_C$ ($S_{B14}$). The adjuster 34 of the driver unit 30 then updates the correction value $C_X$ of the key 22 to be adjusted among the correction data C according to the minimum current $X_{min}$ and updates the correction value $C_Y$ of the key 22 to be adjusted according to the delay time L ($S_{B15}$).

The analyzer 54 determines whether all of the abovementioned processes have been carried out for every key 22 of the keyboard ($S_{B16}$). When the determination result is negative ($S_{B16}$: NO), the adjuster 34 first selects a key 22 that has not been processed as a new key 22 to be adjusted ($S_{B3}$) and then, for that key 22 to be adjusted, carries out the processes from step $S_{B4}$ to step $S_{B15}$. Thus, for each of the keys 22 constituting the keyboard, a correction value $C_X$ and a correction value $C_Y$ are updated, in a sequential manner, according to characteristics of the string-striking mechanism corresponding to the pertaining key 22. When all keys 22 have been processed ($S_{B16}$: YES), the adjusting operation $S_B$ ends.

As will be understood from the above explanation, in the first embodiment, the control data D is adjusted according to results of the analysis of an audio signal Z generated by the sound receiving equipment 40, wherein the audio signal Z corresponds to sounds occurring in the vicinity of the string-striking mechanism 20. Accordingly, an advantage is obtained in that it is possible to adjust a driving condition of the string-striking mechanism 20 in accordance with a characteristic error in the string-striking mechanism 20 with a simple configuration that does not require a sensor(s) to be attached to each key 22, which sensor optically detects the motion of the string-striking mechanism 20. It is of note that although it is also possible to identify the minimum current $X_{min}$ by determining whether striking of a string has taken place by audio perception of a person, such as of the person manufacturing or maintaining the keyboard musical instrument 100, while reducing stepwise a current value $X_{DR}$ of the driving current $I_{DR}$, an operational burden is excessive to carry out such a process for each and every one of the keys 22. In the first embodiment, it is possible to dramatically reduce the burden involved in an adjustment operation since it is possible to automatically identify the minimum current $X_{min}$ through analysis of audio signals Z for multiple cases in which current values $X_{DR}$ of the driving current $I_{DR}$ differ from each other.

It is of note that with a configuration in which the correction data C is fixed as a predetermined value, it is difficult to generate sound at a sufficiently low volume since it is necessary to set a current value $X_{DR}$ and a duration $Y_{DR}$ with sufficient margin such that a string is struck without fail even in a case that a characteristic error exists in the string-striking mechanism 20. In the first embodiment, another advantage is provided in that it is possible to generate sound at a sufficiently low volume. This advantage is obtained since the minimum current $X_{min}$ is determined in accordance with results of analysis of an audio signal Z, and the correction data C (correction value $C_X$) is then adjusted in accordance with the determined minimum current $X_{min}$.

In addition, in the first embodiment, striking of a string by the string-striking mechanism 20 is detected in accordance with an intensity A of an audio signal Z within a search range R that has a predetermined relationship with regard to a timing of commencement of driving of the string-striking mechanism 20. Accordingly, it is possible to detect with high accuracy striking of a string by the string-striking mechanism 20 by reducing an influence of a noise component (e.g., an operation sound of the string-striking mechanism 20) that occurs outside the search range R.

In the first embodiment, striking of a string by the string-striking mechanism 20 is detected by comparison of an intensity A of an audio signal Z and a threshold $A_{TH}$ that corresponds to an intensity $A_N$ of a background noise calculated from an audio signal Z generated before the start of the driving of the string-striking mechanism 20. Accordingly, the first embodiment provides an advantage in that it is possible to accurately detect striking of a string by the string-striking mechanism 20 by setting the threshold $A_{TH}$ to an appropriate value according to a background noise (e.g., an operation sound of equipment (electrical/mechanical equipment in the vicinity to the keyboard musical instrument 100, or thermal noise of the sound receiving equipment 40).

In the first embodiment, the waveform of the driving current $I_{DR}$ supplied to the driving body 62 for when the performance operation $S_A$ is carried out differs from that for when the adjusting operation $S_B$ is carried out. Accordingly, yet another advantage is obtained in that when the performance operation $S_A$ is carried out, a driving current $I_{DR}$ is used whose waveform enables the string-striking mechanism 20 to operate in substantially the same way as, for example, when a performer manually plays the instrument, but when an adjusting operation $S_B$ is carried out, a driving current $I_{DR}$ is used whose waveform is able to reduce the operation sound caused by the string-striking mechanism 20, thereby making it possible to detect with high accuracy striking of a string by reducing the influence of the operation sound of the string-striking mechanism 20. More specifically, since a braking section $Q_4$ used to maintain the state in which the back check 25 stops the hammer 23 is omitted from the driving current $I_{DR}$ supplied when the adjusting operation $S_B$ is carried out, there is reduced an operation sound that is generated from the string-striking mechanism 20 and the driver unit 30 when a current value of the driving current $I_{DR}$ changes from that in the driving section $Q_3$ to that in the braking section $Q_4$. Accordingly, it is possible to detect striking of a string by the string-striking mechanism 20 with high accuracy as compared to a configuration in which a driving current supplied when the adjusting operation $S_B$ is carried out includes a braking section $Q_4$ that is substantially the same as a braking section $Q_4$ supplied when the performance operation $S_A$ is carried out.

In the first embodiment, the minimum current $X_{min}$ that enables the string-striking mechanism 20 to strike a string and a delay time L from when driving of the string-striking mechanism 20 commences till when the string-striking mechanism 20 strikes a string are reflected in the control data D. Therefore, it is possible to adjust a driving condition of the string-striking mechanism 20 in accordance with the control data D and thus compensate for any characteristic errors that exist in the string-striking mechanism 20, which errors may include an error in a minimum current in striking of a string by the string-striking mechanism 20, or a timing error in striking of a string by the string-striking mechanism 20.

Second Embodiment

A second embodiment of the present invention is described below. In the below-exemplified configurations, those elements whose effect or function is substantially the same as in the first embodiment are denoted by the same reference signs as used in the description of the first embodiment, and detailed description of such elements is omitted as appropriate.

In the first embodiment, striking of a string by the string-striking mechanism 20 is detected by comparison of a threshold $A_{TH}$ that corresponds to an intensity $A_N$ of a background noise and an intensity A of an audio signal Z. The analyzer 54 of the second embodiment calculates a maximum value (hereinafter, a "maximum intensity") $A_{max}$ of the intensity A of the audio signal Z within the search range R, and detects striking of a string by the string-striking mechanism 20 by comparing the intensity A of the audio signal Z with a threshold $A_{TH}$ that corresponds to the maximum intensity $A_{max}$. The threshold $A_{TH}$ is a numerical value obtained by multiplying the maximum intensity $A_{max}$ (see FIG. 8) by a predetermined coefficient β (β<1).

A volume of an operation sound of the string-striking mechanism 20 tends to be lower than a volume of a string striking sound of the string-striking mechanism 20. Accordingly, by appropriately selecting the coefficient β, an intensity A that corresponds to an operation sound of the string-striking mechanism 20 of the audio signal Z falls below the threshold $A_{TH}$, and an intensity A that corresponds to a string striking sound of the audio signal Z exceeds the threshold $A_{TH}$. In other words, determining whether the intensity A of an audio signal Z exceeds the threshold $A_{TH}$ enables highly accurate detection of striking of a string by the string-striking mechanism 20 even when, for example, an operation sound of the string-striking mechanism 20 and a string striking sound temporally overlap in the search range R.

Modifications

The above embodiments may be modified in various ways. The following are examples of specific modified embodiments. Two or more embodiments freely selected from the following examples may be combined as appropriate.

(1) The influence of a characteristic error of the string-striking mechanism 20 is audibly prominent when a soft sound is generated that is, for example, within a range approximately between softest striking of a string (pianissimo) to soft striking of a string (mezzo piano). Accordingly, correction may be carried out, such correction including correcting a standard current value $X_0$ in accordance with a correction value $C_X$ and also correcting a standard duration $Y_0$ in accordance with a correction value $C_Y$, only when a performance intensity V that is below a predetermined threshold is indicated (i.e., when a soft sound is generated). When a performance intensity V that exceeds the threshold is indicated, the standard current value $X_0$ is set as a current value $X_{DR}$ of the driving section $Q_3$ and the standard duration $Y_0$ is set as a duration $Y_{DR}$ of the driving section $Q_3$.

(2) In the previous embodiments, the control unit 10 and the driver unit 30 are exemplified as separate elements. Alternatively, a configuration may be provided in which the control unit 10 and the driver unit 30 consist of a single unit. More specifically, the controller 64 and the adjuster 34 may be realized by the controller 12 executing a program stored in the storage device 14, and the control data D being stored in the storage device 14.

(3) In the previous embodiments, a striking sound is detected by focusing on a search range R along the time axis. However, it is also possible to detect a striking sound by analyzing an audio component in a frequency band that includes a pitch of a key 22, to be adjusted, of an audio signal Z (i.e., the frequency band component that is expected to be the striking sound). According to a configuration in which a striking sound is detected by limiting the frequency band, it is possible to highly accurately detect striking of a string by the string-striking mechanism 20 even when the striking sound and an operation sound temporally overlap. The detection of the striking sound, however, may be encumbered if the instrument is not appropriately tuned, namely, if a frequency error exists in the striking sound. Accordingly, from a view point of detecting striking of a string with high accuracy regardless of a tuning condition of the keyboard musical instrument 100, as exemplified in the previous embodiments, a desirable configuration is one in which striking of a string by the string-striking mechanism 20 is detected by limiting to a search range R along the time axis.

(4) In the previous embodiments, a candidate value $X_C$ of a minimum current $X_{min}$ is decreased stepwise from an initial value ($S_{B12}$). Alternatively, a configuration can be provided in which it is possible to specify the minimum current $X_{min}$ by increasing the candidate value $X_C$ from the initial value in a stepwise manner. More specifically, the candidate value $X_C$ is increased stepwise from an initial value ($S_{B4}$) that is sufficiently small not to generate striking of a string by the string-striking mechanism 20, and the candidate value $X_C$ immediately before the time point at which striking of a string by the string-striking mechanism 20 occurs is specified as a minimum current $X_{min}$.

(5) In the previous embodiments, an example is given of a configuration in which the control data D includes the correction data C that is different from the current value data Dx and the duration data $D_Y$. In an alternative configuration, the correction data C may be omitted. For example, it is possible to omit the correction data C in a configuration in which a current value $X_{DR}$ corresponding to each performance intensity V is determined by the current value data $D_X$, and in which a duration $Y_{DR}$ corresponding to each performance intensity V is determined by the duration data $D_Y$. In a configuration in which the correction data C is omitted, each current value $X_{DR}$ defined by the current value data $D_X$ is adjusted by the adjusting operation $S_B$ in accordance with a minimum current $X_{min}$, and each duration $Y_{DR}$ defined by the duration data $D_Y$ is adjusted by the adjusting operation $S_B$ in accordance with a delay time L. As will be understood from the above example, adjustment of the control data D by the adjuster 34 may include, besides adjustment of the correction value $C_X$ and the correction value $C_Y$, adjustment of a current value $X_{DR}$ and a duration $Y_{DR}$ in a configuration in which the correction data C is omitted.

(6) In the previous embodiments, a configuration is exemplified in which a current value $X_{DR}$ and a duration $Y_{DR}$ of a driving current $I_{DR}$ in a driving section $Q_3$ are designated by the control data D as a driving condition of the string-striking mechanism 20. Alternatively, a configuration may be provided in which the adjusting operation $S_B$ is carried out for either one of the current value $X_{DR}$ and the duration $Y_{DR}$.

(7) In the previous embodiments, a configuration is exemplified in which the control unit 10, the driver unit 30, and the sound receiving equipment 40 are provided as a part of the keyboard musical instrument 100. Alternatively, a part or all of the control unit 10, a part or all of the driver unit 30, and the sound receiving equipment 40 may be an external unit attachable to the string-striking mechanism 20. For example, the analyzer 54, the adjuster 34, and the storage circuit 36 in addition to the sound receiving equipment 40 may be distributed as an external unit such that the unit is attachable to (i.e., detachable from) an automatic player piano (the keyboard musical equipment 100) that has the driving bodies 62 arranged on the string-striking mechanism 20, the controller 64, the performance controller 52, and the storage device for having stored the performance data P therein. Alternatively, the keyboard musical instrument 100 may additionally be provided with a communication unit for performing communication with an apparatus (typically, a server apparatus) via a communication network, such as the Internet, and the analyzer 54, the adjuster 34, and the storage circuit 36 may be provided in such a server apparatus such that the keyboard musical instrument 100 transmits audio signals Z to the server apparatus to cause the analyzer 54 and the adjuster 34 to perform the adjustment operation, to receive after adjustment the correction data C from the server apparatus.

(8) In the previously mentioned embodiments, the keyboard musical instrument 100 is exemplified, but the present invention may be realized as a program. In one aspect, a program is executable by a computer to execute a method of adjusting a keyboard musical instrument, the method comprising detecting striking of a string by the string-striking mechanism 20 through analysis of an audio signal Z that is generated when the string-striking mechanism 20 operates and adjusting the control data D in accordance with results of the analysis, wherein the computer is able to control: the string-striking mechanism 20 that strikes a string responsive to a change in position of an associated one of the keys 22 that constitute a keyboard; the driver 32 that drives the string-striking mechanism 20 under a driving condition corresponding to the control data D; and the sound receiving equipment 40 that generates an audio signal Z corresponding to sounds occurring in the vicinity of the string-striking mechanism 20. The above-exemplified program may be provided in a format that is stored in a computer-readable recording medium and installed in a computer. The recording medium is, for example, a non-transitory recording medium, and preferable examples thereof include an optical recording medium (optical disc) such as a CD-ROM, but may include a recording medium of any publically known format such as a semiconductor recording medium or a magnetic recording medium. It is alternatively possible to distribute the program to a computer via a communication network. In this case, a server apparatus may have the program stored in a recording medium, such as a hard disk, therein, such that the program may be downloaded from the server apparatus to a computer via a communication network.

The following aspects of the invention may be understood from the foregoing descriptions. In one aspect of the present invention there is provided a keyboard musical instrument in which the above-stated object is realized. In this aspect, the keyboard musical instrument of the present invention includes a string-striking mechanism configured to strike a string responsive to a change in position of an associated one of keys that constitute a keyboard; a driver configured to drive the string-striking mechanism under a driving condition in accordance with control data; a sound receiver configured to generate an audio signal corresponding to a sound occurring in the vicinity of the string-striking mechanism; an analyzer configured to detect striking of a string by the string-striking mechanism through analysis of the audio signal generated when the string-striking mechanism operates; and an adjuster configured to adjust the control data in accordance with results of the analysis by the analyzer. In this aspect, the control data that indicates a driving condition of the string-striking mechanism is adjusted in accordance with results of the analysis of the audio signal generated by the sound receiver corresponding to a sound occurring in the vicinity of the string-striking mechanism. Consequently, an advantage is obtained in that it is possible to adjust a driving condition of the string-striking depending on a degree of a characteristic error that occurs in the string-striking mechanism by use of a simple configuration without need for disposing a(n) optical sensor(s) for each key of a keyboard to detect movement of the string-striking mechanism.

The analyzer is configured to detect striking of a string by the string-striking mechanism in accordance with an intensity of an audio signal within a search range, the search range having a predetermined relationship along a time axis with regard to a time at which the operation of the string-striking mechanism commences. Moreover, the striking of a string by the string-striking mechanism is detected in accordance with the intensity of the audio signal within a search range that has a predetermined relationship relative to a start of driving of the string-striking mechanism. In this way, an advantage is obtained in that it is possible to detect the striking of a string by the string-striking mechanism with high accuracy by reducing an influence of noise components (e.g., operation sound of the string-striking mechanism) that occurs outside the search range.

In another aspect, there is provided an adjusting method of a keyboard musical instrument having a string-striking mechanism that strikes a string responsive to a change in position of an associated one of keys that constitute a keyboard, the method including: detecting striking of a string by the string-striking mechanism through analysis of an audio signal when the string-striking mechanism operates, the audio signal corresponding to a sound occurring in the vicinity of the string-striking mechanism and being generated by a sound receiver provided with the keyboard musical instrument, wherein the striking by the string-striking mechanism is detected in accordance with an intensity of the audio signal occurring within a search range, the search range having a predetermined relationship along a time axis with regard to a time at which the string-striking mechanism commences operation; and adjusting control data in accordance with results of the analysis, the control data designating a driving condition for driving the string-striking mechanism.

Further, in yet another aspect, there is provided a non-transitory computer-readable recording medium storing a program executable by a computer to execute the above method of adjusting the keyboard musical instrument. The substantially same effects as those described above can be obtained according to the method and the non-transitory computer-readable recording medium of the above aspects.

The analyzer can calculate an intensity of a background noise from the audio signal generated before driving of the string-striking mechanism commences, and detect the striking by the string-striking mechanism by comparing a threshold that corresponds to the intensity of the background noise with the intensity of the audio signal. In this aspect, the striking of a string by the string-striking mechanism is detected through comparison between the threshold corresponding to the intensity of the background noise calculated from the audio signal generated before driving of the string-striking mechanism commences and the intensity of the audio signal. Therefore, an advantage is obtained in that it is possible to detect with high accuracy striking of a string by the string-striking mechanism by setting an appropriate threshold that corresponds to background noise, including, for example, an operation sound of electric appliances such as air conditioners and the like in the vicinity to the keyboard musical instrument 100, or thermal noise of the sound receiver.

The analyzer can calculate a maximum intensity of the audio signal and detects the striking of a string by the string-striking mechanism by comparing a threshold that corresponds to the maximum intensity with the intensity of the audio signal. In this aspect, the striking of a string by the string-striking mechanism is detected by comparing the threshold corresponding to the maximum intensity of the audio signal and the intensity of the audio signal. Therefore, an advantage is obtained in that it is possible to detect the striking of a string by the string-striking mechanism with high accuracy even in a case where the operation sound of the string-striking mechanism and the string striking sound temporally overlap.

The driver may include a driving body for each key that is configured to drive the string-striking mechanism; and a controller configured to drive the string-striking mechanism by supplying the driving body with a driving current in accordance with the control data.

The controller can differentiate a waveform of a driving current supplied when a performance operation is being carried out from a waveform of a driving current supplied when an adjusting operation is being carried out. In the performance operation, the driving body is driven in accordance with performance data that designates a content of the performance; and in the adjusting operation the control data is adjusted in accordance with results of the analysis by the analyzer. In this aspect, the waveform of the driving current supplied to the driving body differs depending on whether a performance operation is being carried out, or whether an adjusting operation is being carried out. Thus, an advantage is obtained in that it is possible to detect the striking of a string by the string-striking mechanism with high accuracy, since an influence of the operation sound of the string-striking mechanism is reduced, on the one hand, when the performance operation is being carried out, by use of a driving current with a waveform under supply of which the string-striking mechanism is able to operate in substantially the same manner as, for example, when a performer manually performs on the instrument, and on the other hand, when the adjusting operation is being carried out, by use of a driving current with a waveform that reduces an influence of the operation sound of the string-striking mechanism.

The string-striking mechanism can include, in association with each key, a hammer that strikes a string by pivoting in conjunction with a change in position of an associated key, and a back check that brings the hammer to a halt after it has struck the string. Further, during a performance operation, a driving current is supplied that includes a braking section to maintain a state in which the back check has halted the hammer; but when an adjusting operation is being carried out a driving current is supplied that does not include the braking section. In this aspect, the operation sound generated by the string-striking mechanism due to a change in a current value of the driving current in the braking section is reduced since the braking section, which is supplied to maintain the state in which the back check has placed the hammer in a halt, is omitted from the driving current when the adjusting operation is being carried out. As a result, an advantage is obtained in that it is possible to detect the striking of a string by the hammer with high accuracy, in contrast to a configuration in which the driving current supplied when the adjusting operation is being carried out includes a braking section as in the case when a performance operation is being carried out.

The controller can sequentially change the current value of the driving current, and the analyzer can identify, for each key, a minimum current under supply of which the string-striking mechanism is made capable of striking a string, and a delay time from when driving of the string-striking mechanism commences to when the string-striking mechanism strikes a string, based on results of string strike detections when the string-striking mechanism is made to operate under supply of driving currents having different values, whereby the adjuster can adjust the control data in accordance with the minimum current and the delay time. According to this configuration, the minimum current under supply of which the string-striking mechanism can strike a string and the delay time from when driving of the string-striking mechanism commences to when a string is struck are reflected in the control data. Therefore, an advantage is obtained in that a driving condition of the string-striking mechanism can be adjusted so as to compensate a characteristic error in the string-striking mechanism, including an error in the minimum current under supply of which the string-striking mechanism can strike a string, or a timing error of the striking of string by the string-striking mechanism.

DESCRIPTION OF REFERENCE SIGNS

100 . . . keyboard instrument, 10 . . . control unit, 12 . . . controller, 14 . . . storage device, 20 . . . string-striking mechanism, 21 . . . string, 22 . . . key, 23 . . . hammer, 24 . . . transmission member, 25 . . . back check, 30 . . . driver unit, 32 . . . driver, 34 . . . adjuster, 36 . . . storage circuit, 40 . . . sound receiving equipment, 52 . . . performance controller, 54 . . . analyzer, 62 . . . driving body, 64 . . . controller.

What is claimed is:

1. A keyboard musical instrument comprising:

a string-striking mechanism configured to strike a string responsive to a change in position of an associated one of keys of a keyboard;

a driver including a driving body for each key that is configured to drive the string-striking mechanism for the respective key;

a sound receiver configured to generate an audio signal corresponding to sound occurring in the keyboard musical instrument;

at least one controller each including a processor or circuitry configured to implement instructions stored in a memory and execute a plurality of tasks, including:

a detecting task that detects striking of a string by the string-striking mechanism through analysis of the audio signal from the sound receiver when the string-striking mechanism operates, in accordance with an intensity of the audio signal within a search range that has a predetermined relationship along a time axis with regard to a time at which operation of the string-striking mechanism commences;

a current supplying task that supplies electric driving current to the driving body in accordance with the control data to drive the string-striking mechanism for the respective key;

a current changing task that sequentially changes a value of electric driving current to provide electric driving currents having different values;

an identifying task that identifies, for each key, minimum electric driving current applied to the respective driving body that drives the string-striking mechanism to strike a string, and a delay time from when driving of the string-striking mechanism commences to when the string-striking mechanism strikes the string, based on results of string strike detections when the string-striking mechanism is made to operate with the electric driving currents having different values; and an adjusting task that adjusts the control data in accordance with the identified minimum electric driving current and the identified delay time.

2. The keyboard musical instrument according to claim 1, wherein:

the plurality of tasks include a calculating task that calculates an intensity of a background noise from the audio signal generated before the driving body of the respective key drives the string-striking mechanism; and the detecting task detects the striking by the string-striking mechanism by comparing a threshold that corresponds to the intensity of the background noise with the intensity of the audio signal.

3. The keyboard musical instrument according to claim 1, wherein:

the plurality of tasks include a calculating task that calculates a maximum intensity of the audio signal; and the detecting task detects the striking of a string by the string-striking mechanism by comparing a threshold that corresponds to the maximum intensity with the intensity of the audio signal.

4. The keyboard musical instrument according to claim 1, wherein:

the plurality of tasks include:

a differentiating task that differentiates a waveform of electric driving current supplied to the driving body when a performance operation is being carried out, from a waveform of driving current supplied when the adjusting operation is being carried out; and a driving task that, in the performance operation, drives the driving body in accordance with performance data that designates a content of a performance, and wherein the adjusting task, in the adjusting operation, adjusts the control data in accordance with the results of the detecting task.

5. A keyboard musical instrument comprising:

a string-striking mechanism configured to strike a string responsive to a change in position of an associated one of keys of a keyboard, and including, in association with each key:

a hammer that strikes the associated string by a pivoting action in conjunction with the change in position of the associated key; and a back check that brings the hammer to a halt after striking the string;

a driver including a driving body for each key that is configured to drive the string-striking mechanism for the respective key;

a sound receiver configured to generate an audio signal corresponding to sound occurring in the keyboard musical instrument;

at least one controller each including a processor or circuitry configured to implement instructions stored in a memory and execute a plurality of tasks, including:

a detecting task that detects striking of a string by the string-striking mechanism through analysis of the audio signal from the sound receiver when the string-striking mechanism operates, in accordance with an intensity of the audio signal within a search range that has a predetermined relationship along a time axis with regard to a time at which operation of the string-striking mechanism commences;

an adjusting task that adjusts the control data in accordance with a result of the detecting task; and a current supplying task that supplies electric driving current to the driving body in accordance with the control data to drive the string-striking mechanism for the respective key, and that:

provides, when a performance operation is being carried out, a braking operation to permit the hammer to be halted by the back check; and does not provide, when the adjusting operation is being carried out, the braking operation.

6. An adjusting method of a keyboard musical instrument including:

a string-striking mechanism that strikes a string responsive to a change in position of an associated one of keys of a keyboard;

a driver including a driving body for each key that is configured to drive the string-striking mechanism for the respective key; and a sound receiver configured to generate an audio signal corresponding to sound occurring in the keyboard musical instrument, the method comprising the steps of:

detecting striking of a string by the string-striking mechanism through analysis of an audio signal from the sound receiver when the string-striking mechanism operates, in accordance with an intensity of the audio signal within a search range that has a predetermined relationship along a time axis with regard to a time at which operation of the string-striking mechanism commences;

supplying electric driving current to the driving body in accordance with the control data to drive the string-striking mechanism for the respective key;

sequentially changing a value of electric driving current to provide electric driving currents having different values;

identifying, for each key, minimum electric driving current applied to the respective driving body that drives the string-striking mechanism to strike a string, and a delay time from when driving of the string-striking mechanism commences to when the string-striking mechanism strikes the string, based on results of string strike detections when the string-striking mechanism is made to operate with the electric driving currents having different values; and adjusting the control data in accordance with, the identified minimum electric driving current and the identified delay time.

* * * * *